US008317948B2

(12) United States Patent
Era et al.

(10) Patent No.: US 8,317,948 B2
(45) Date of Patent: Nov. 27, 2012

(54) COPPER ALLOY FOR ELECTRONIC MATERIALS

(75) Inventors: Naohiko Era, Hitachi (JP); Kazuhiko Fukamachi, Hitachi (JP); Hiroshi Kuwagaki, Hitachi (JP)

(73) Assignee: JX Nippon Mining & Metals Corporation, Minato-Ku, Tokyo (JP)

( * ) Notice: Subject to any disclaimer, the term of this patent is extended or adjusted under 35 U.S.C. 154(b) by 981 days.

(21) Appl. No.: 11/886,829

(22) PCT Filed: Mar. 23, 2006

(86) PCT No.: PCT/JP2006/305842

§ 371 (c)(1),
(2), (4) Date: Oct. 11, 2007

(87) PCT Pub. No.: WO2006/101172

PCT Pub. Date: Sep. 28, 2006

(65) Prior Publication Data

US 2009/0035174 A1 Feb. 5, 2009

(30) Foreign Application Priority Data

Mar. 24, 2005 (JP) ..... 2005-85907

(51) Int. Cl.
*C22C 9/06* (2006.01)
*C22F 1/08* (2006.01)

(52) U.S. Cl. ..... 148/435; 148/554; 148/681; 148/682; 148/684; 148/685; 420/485

(58) Field of Classification Search ..... 148/435, 148/554, 681, 682, 684, 685; 420/485
See application file for complete search history.

(56) References Cited

U.S. PATENT DOCUMENTS

| | | | | | |
|---|---|---|---|---|---|
| 2,241,815 | A * | 5/1941 | Hensel et al. | ..... | 148/553 |
| 4,191,601 | A * | 3/1980 | Edens et al. | ..... | 148/686 |
| 4,594,221 | A | 6/1986 | Caron et al. | ..... | 420/485 |
| 4,657,601 | A * | 4/1987 | Guha | ..... | 148/685 |
| 4,687,633 | A * | 8/1987 | Miyafuji et al. | ..... | 420/481 |
| 5,021,105 | A * | 6/1991 | Asai et al. | ..... | 148/433 |
| 2002/0029827 | A1 | 3/2002 | Liu et al. | ..... | 148/554 |
| 2002/0127133 | A1 * | 9/2002 | Usami et al. | ..... | 420/485 |

(Continued)

FOREIGN PATENT DOCUMENTS

JP 3271351 12/1991

(Continued)

OTHER PUBLICATIONS

Chem Abstract 145:402149, abstracting JP2006283059 (Oct. 19, 2006).

(Continued)

*Primary Examiner* — Sikyin Ip
(74) *Attorney, Agent, or Firm* — Drinker Biddle & Reath LLP

(57) ABSTRACT

The invention provides Cu—Ni—Si alloys containing Co, and having excellent strength and conductivity. A copper alloy for electronic materials in accordance with the invention contains about 0.5-about 2.5% by weight of Ni, about 0.5-about 2.5% by weight of Co, about 0.30-about 1.2% by weight of Si, and the balance being Cu and unavoidable impurities, wherein the ratio of the total weight of Ni and Co to the weight of Si ([Ni+Co]/Si ratio) satisfies the formula: about 4≦[Ni+Co]/Si≦about 5, and the ratio of Ni to Co (Ni/Co ratio) satisfies the formula: about 0.5≦Ni/Co≦about 2.

6 Claims, 1 Drawing Sheet

U.S. PATENT DOCUMENTS

| | | | | |
|---|---|---|---|---|
| 2005/0028907 | A1 | 2/2005 | Hasegawa et al. | 148/683 |

FOREIGN PATENT DOCUMENTS

| | | | | |
|---|---|---|---|---|
| JP | 5179377 | | | 7/1993 |
| JP | 05179377 | A2 | * | 7/1993 |
| JP | 2001-207229 | | | 7/2001 |
| JP | 3510469 | | | 1/2004 |
| PL | 119646 | | * | 1/1982 |
| SU | 456019 | | * | 1/1975 |
| WO | WO 03/076672 | A1 | | 9/2003 |
| WO | WO 2004/005560 | A2 | | 1/2004 |

OTHER PUBLICATIONS

Chem Abstract 141:414240, abstracting JP2004315940 (Nov. 11, 2004).

Chem Abstract 135:64906, abstracting JP2001181759 (Jul. 3, 2001).

* cited by examiner

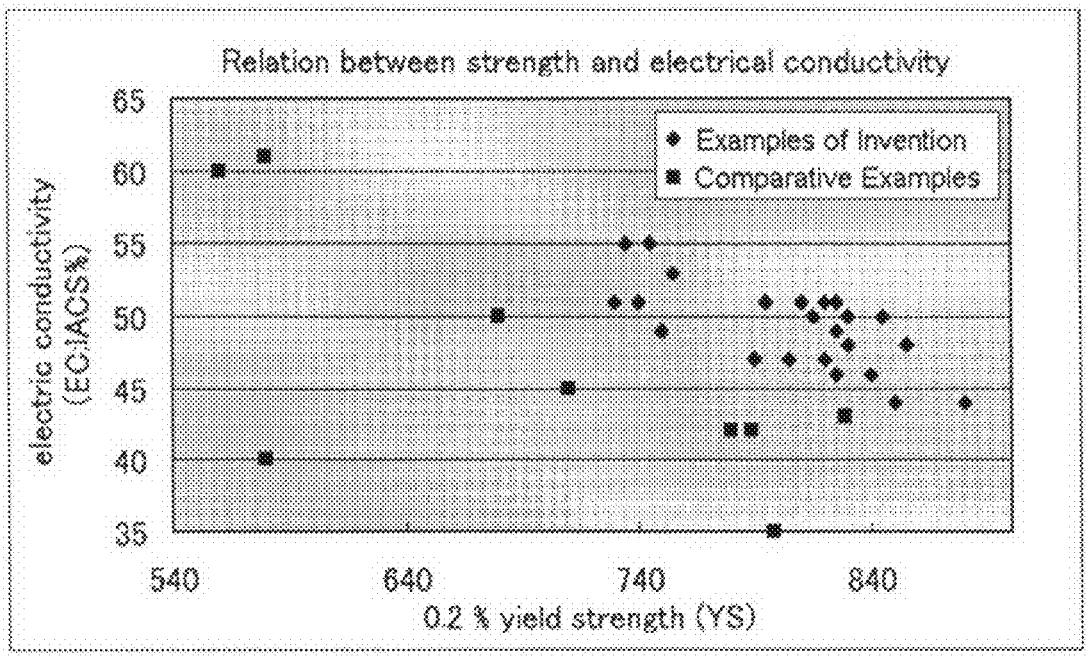
Relation between strength and electrical conductivity
Examples of Invention
Comparative Examples
electric conductivity (EC:IACS%)
65
60
55
50
45
40
35
540
640
740
840
0.2 % yield strength (YS)

COPPER ALLOY FOR ELECTRONIC MATERIALS

FIELD OF THE INVENTION

The present invention relates to precipitation hardening copper alloys, in particular, to Cu—Ni—Si copper alloys suitable for use in a variety of electronic components.

BACKGROUND OF THE INVENTION

A copper alloy in for electronic components such as a lead frame, connector, pin, terminal, relay and switch is required to satisfy both high-strength and high-electrical conductivity (or high-thermal conductivity) as a basic characteristic. In recent years, as high-integration and reduction in size and thickness of an electronic component have been rapidly advancing, requirements for copper alloys used in these electronic components have been sophisticated more than ever.

However, the characteristics of copper alloys as well as other alloys are affected by their composition elements and crystal structures, and condition of heat-treatment. In addition, the predictability of the effect caused by a subtle change in the composition elements or condition of heat-treatment on the characteristics of the alloys is generally very low. Therefore, it has been very difficult to develop a novel copper alloy satisfying continuously increasing requirements.

In recent years, with consideration to high-strength and high-electrical conductivity, the usage of age hardening copper alloys in electronic components has been increasing, replacing traditional solid-solution hardening copper alloys as typified by phosphor bronze and brass. In the age hardening copper alloys, the age hardening of supersaturated solid solution, which underwent solution treatment beforehand, disperses fine precipitates uniformly, thereby increasing the strength of the alloys. At the same time, it also reduces the amount of solute elements contained in the copper, thereby increasing electric conductivity. For this reason, it provides materials having excellent mechanical characteristics such as strength and stiffness, as well as high electrical and thermal conductivity.

Among the age hardening copper alloys, Cu—Ni—Si copper alloys are typical copper alloys having both relatively high electrical conductivity, strength, stress relaxation characteristic and bending workability, and therefore they are among the alloys that have been actively developed in the industry in these days. In these copper alloys, fine particles of Ni—Si intermetallic compounds are precipitated in copper matrix, thereby increasing strength and electrical conductivity.

In general, the precipitation of Ni—Si intermetallic compounds, which contributes to improve strength, is composed of stoichiometric composition. For example, Japanese patent laid-open publication No. 2001-207229 discloses a way of achieving good electrical conductivity by bringing the mass ratio of Ni and Si in an alloy close to the mass composition ratio of the intermetallic compound, $Ni_2Si$ (Ni atomic weight×2: Si atomic weight×1), namely, by adjusting the mass ratio of Ni and Si such that the ratio Ni/Si becomes from 3 to 7.

Further, Japanese patent publication No. 3510469 states that, similar to Ni, Co forms compounds with Si, thereby increasing mechanical strength, and Cu—Co—Si alloys, when age-hardening, have slightly better mechanical strength and electrical conductivity than Cu—Ni—Si alloys. Further, it also states that, where acceptable in cost, Cu—Co—Si and Cu—Ni—Co—Si alloys may be also selectable.

Further, Japanese patent publication No. 2572042 mentions Co as an example of silicide forming elements and impurities which give no adverse effect on properties of copper alloys. It also states that such element, if existed in the alloy, should be contained by replacing the equivalent amount of Ni, and may be contained in the effective amount equal to or less than about 1%.

However, Co is more expensive than Ni as stated in the aforementioned document, and thereby has the drawback in practical use. Therefore, no or few meticulous studies have been conducted on Cu—Ni—Si alloys using Co as an additive element in the past. In addition, it has been believed that, similar to Ni, Co forms compounds with Si, and slightly increases mechanical strength and electrical conductivity by replacing Ni. However, it has never been conceived that Co dramatically improves characteristics of alloys.

Problems to be Solved by the Invention

The object of the invention is to provide precipitation hardening copper alloys having excellent characteristics, satisfying both high-strength and high-electrical conductivity (or high-thermal conductivity). In particular, the object of the invention is, by adding Co to the alloys, to provide Cu—Ni—Si alloys for electronic materials having dramatically improved strength with minimal decrease of electrical conductivity.

Means for Solving the Problem

The inventors have diligently studied to cope with the requirements for copper alloys used for increasingly sophisticated electronic materials, and eventually have focused on Cu—Ni—Si alloys containing Co. Then, after examinations on Cu—Ni—Si alloys containing Co, we have found out that the strength of Cu—Ni—Si alloys containing Co improves more dramatically than expected from the explanation of prior art under the certain range of composition. In addition, we have also found out that these Cu—Ni—Si alloys satisfying the aforementioned compositional range shows less decrease of electrical conductivity incident to the improvement of strength, as well as a good bendability, stress relaxation characteristic, and solderability.

The present invention has been made based on these findings, and in one aspect, is a copper alloy for electronic materials, containing about 0.5-about 2.5% by weight of Ni, about 0.5-about 2.5% by weight of Co, and about 0.30-about 1.2% by weight of Si, and the balance being Cu and unavoidable impurities, wherein the ratio of the total weight of Ni and Co to the weight of Si ([Ni+Co]/Si ratio) in the alloy composition satisfies the formula: about $4 \leqq [Ni+Co]/Si \leqq$ about 5, and the ratio of Ni to Co (Ni/Co ratio) in the alloy composition satisfies the formula: about $0.5 \leqq Ni/Co \leqq$ about 2.

In another aspect, the invention is the copper alloy for electronic materials, further containing about 0.5% or less by weight of Cr.

In a further aspect, the invention is the copper alloy for electronic materials, further containing in total about 2.0% or less by weight of one or more elements selected from the group consisting of P, As, Sb, Be, B, Mn, Mg, Sn, Ti, Zr, Al, Fe, Zn and Ag.

In a further aspect, the invention is a copper product using the aforementioned copper alloy.

In a further aspect, the invention is an electronic component using the aforementioned copper alloy.

In a further aspect, the invention is a method for manufacturing copper alloys for electronic materials, comprising:

a melt-casting process of an ingot containing about 0.5-about 2.5% by weight of Ni, about 0.5-about 2.5% by weight of Co, and about 0.30-about 1.2% by weight of Si, and the balance being Cu and unavoidable impurities, wherein the ratio of the total weight of Ni and Co to the weight of Si ([Ni+Co]/Si ratio) satisfies the formula: about 4≦[Ni+Co]/Si≦about 5, and the ratio of Ni to Co (Ni/Co ratio) satisfies the formula: about 0.5≦Ni/Co≦about 2;

a hot rolling process;

a cold rolling process;

a solution treatment process of heating to about 700° C.-about 1000° C., and then cooling at the rate of 10° C. per second or more;

an optional cold rolling process;

an age hardening process conducted at about 350° C.-about 550° C.; and an optional cold rolling process;

wherein said processes are conducted in the order as listed above.

In one aspect of the manufacturing method of the invention, said ingot may further contain about 0.5% or less by weight of Cr.

In another aspect of the manufacturing method of the invention, said ingot may further contain in total about 2.0% or less by weight of one or more elements selected from the group consisting of P, As, Sb, Be, B, Mn, Mg, Sn, Ti, Zr, Al, Fe, Zn and Ag.

Advantageous Effect of the Invention

The invention provides Cu—Ni—Si alloys for electronic materials having dramatically improved strength with minimal decrease in electrical conductivity, and also having good stress relaxation characteristic and solderability.

BRIEF DESCRIPTION OF THE DRAWINGS

FIG. 1 shows the relation between yield strengths (YS) and electrical conductivities (EC) for examples of the invention and comparative examples.

BEST MODE FOR CARRYING OUT THE INVENTION

Addition Amount of Ni, Co and Si

Ni, Co and Si form an intermetallic compound with appropriate heat-treatment, and make it possible to increase strength without adversely affecting electrical conductivity. Respective addition amount of Ni, Co and Si is explained hereinafter.

With regard to Ni and Co, addition amount should be Ni: about 0.5-about 2.5 wt % and Co: about 0.5-about 2.5 wt % to achieve the target strength and electrical conductivity. It is preferably Ni: about 1.0-about 2.0 wt % and Co: about 1.0-about 2.0 wt %, and more preferably Ni: about 1.2-about 1.8 wt % and Co: about 1.2-1.8 wt %. On the contrary, Ni: less than about 0.5 wt % or Co: less than about 0.5 wt % doesn't achieve the desired strength. Ni: more than about 2.5 wt % or Co: more than about 2.5 wt % significantly decreases electrical conductivity and impairs hot workability although it increases strength.

With regard to Si, addition amount should be about 0.30-about 1.2 wt % to achieve the target strength and electrical conductivity, and preferably, about 0.5-about 0.8 wt %. On the contrary, Si: less than about 0.3 wt % doesn't achieve the desired strength, and Si: more than about 1.2 wt % significantly decreases electrical conductivity and impairs hot workability although it increases strength.

[Ni+Co]/Si Ratio

The invention defines the ratio of the total weight of Ni and Co to the weight of Si ([Ni+Co]/Si ratio).

The invention defines Ni/Si ratio at a lower numerical range than conventional range of about 3≦Ni/Si≦about 7, namely adjusts the ratio to the range with higher Si concentration so that Si contributes to the silicide formation of Ni and Co, which are added with Si, and lessens the decrease of electrical conductivity due to the solid solution of excess Ni and Co, which do not contribute to the precipitation. However, if the ratio is in the range of [Ni+Co]/Si<about 4, Si ratio becomes so high that electrical conductivity decreases due to the solid solution of Si. In addition, since a $SiO_2$ oxide film is formed on the material surface during annealing process, solderability deteriorates. Further, since Ni—Co—Si precipitation particles, which don't contribute to strengthening, have a tendency to enlarge, and thereby to become starting points of fractures during bending process and cause plating defects. On the other hand, if the ratio of Ni and Co to Si becomes higher and is in the range of [Ni+Co]/Si>about 5, high strength cannot be achieved due to the lack of Si necessary for silicide formation.

Accordingly, the invention adjusts the [Ni+Co]/Si ratio within the range of about 4≦[Ni+Co]/Si≦about 5.

Preferably, the [Ni+Co]/Si ratio is in the range of about 4.2≦[Ni+Co]/Si≦about 4.7.

Ni/Co Ratio

The invention also defines a ratio of Ni to Co (Ni/Co ratio). It is believed that Ni and Co not only contribute to the compound formation with Si, but also improve characteristics of the alloy by their mutual relation, although the invention is not limited by this theory. The improvement of strength becomes prominent when Ni/Co ratio is in the range of about 0.5≦Ni/Co≦about 2. Preferably, the ratio is in the range of about 0.8≦Ni/Co≦about 1.3. On the contrary, if the ratio is in the range of Ni/Co<about 0.5, electrical conductivity decreases although it increases strength. In addition, such ratio causes solidification segregation during melt-casting process. On the other hand, if Ni/Co ratio is undesirably higher than about 2, Ni concentration becomes too high and electrical conductivity decreases.

Addition Amount of Cr

In accordance with the invention, about 0.5 wt % or less of Cr may be added to the aforementioned Cu—Ni—Si alloy containing Co. Preferably, the addition amount is in the range of about 0.09-about 0.5 wt %, and more preferably, the amount is in the range of about 0.1-about 0.3 wt %. Cr precipitates as Cr by itself or as compounds with Si within copper matrix, allowing the increase of electrical conductivity without adversely affecting strength. However, when the amount is lower than about 0.09 wt %, the effect becomes too small undesirably. On the other hand, when the amount is larger than about 0.5 wt %, the precipitates become large inclusions, which don't contribute to the increase of strength and deteriorates bending workability and plating characteristic.

Other Additive Elements

The addition of P, As, Sb, Be, B, Mn, Mg, Sn, Ti, Zr, Al, Fe, Zn or Ag exhibits a variety of effects. These elements complement mutually and improve not only strength and electrical conductivity but also bending workability, plating characteristic, and productivities such as hot workability due to the miniaturization of cast structure. Therefore, one or more of these elements may be added to the aforementioned Cu—Ni—Si alloy containing Co depending on desired characteristics. In such case, their total amount should be equal to or less than about 2.0 wt %. Preferably, it is in the range of about 0.001-2.0 wt %, and more preferably, it is in the range of about 0.01-1.0 wt %. On the contrary, if the total amount is less than about 0.001 wt %, the desired effect cannot be achieved, and if it is more than about 2.0 wt %, electrical conductivity and productivity decrease significantly.

A copper alloy in accordance with the invention can be manufactured by a conventional manufacturing method of Cu—Ni—Si alloys, and a person skilled in the art can choose an optimal manufacturing method depending on composition and desired characteristics. Therefore, there seems to be no need for specific explanation. However, a typical manufacturing method is explained for illustrative purpose hereinafter. In typical manufacturing process for Cu—Ni—Si copper alloys, firstly, ingredients such as electrolytic cathode copper, Ni, Si and Co are melted with an atmospheric melting furnace to prepare a melt of desired composition. Then, the melt is cast into an ingot. Then, after hot rolling process is conducted, cold rolling and heat-treatment processes are repeated to produce a strip, foil or the like having desired thickness and characteristics. The heat-treatment may include solution treatment and age hardening. In the solution treatment, the wrought alloy is heated to about 700° C.-about 1000° C. to solve Ni—Si compounds or Co—Si compounds into Cu matrix, and to recrystallize the Cu matrix at the same time. The hot rolling process may sometimes serve as the solution treatment. In the age hardening, the wrought alloy is heated for one hour or more in the temperature range of about 350° C.-about 550° C. so that the solved Ni, Co and Si by the solution treatment is precipitated as fine particles of Ni—Si compounds and Co—Si compounds. This age hardening process increases strength and electrical conductivity. Cold rolling may be conducted before and/or after the age hardening to achieve higher strength. Further, if cold rolling is conduced after age hardening, stress relief annealing (low temperature annealing) may be conducted after the cold rolling.

However, the inventors have found out that the strength of Cu—Ni—Si alloys in accordance with the invention can be further improved by intentionally accelerating the cooling rate after the heating in the solution treatment. Specifically, the effective cooling rate is 10° C. per second or more when it is cooled to about 400° C.-room temperature. Preferably, it is about 15° C. per second or more, and more preferably, it is about 20° C. per second or more. However, if the cooling rate is too high, the effect for higher strength becomes insufficient. Therefore, preferably, it is about 30° C. or less per second, and more preferably, it is about 25° C. or less. The control of cooling rate may be performed with any well-known method by those in the art. In general, the decrease of the amount of water flow per unit time may introduce the decrease of cooling rate. Therefore, for example, the increase of cooling rate can be achieved by additional water-cooling nozzles or by the increase of the amount of water per unit time. Incidentally, the term "cooling rate" means a value (° C./second) determined by measuring a cooling time from solution treatment temperature (700° C.-1000° C.) to 400° C., then calculating with the following equation, "(solution treatment temperature −400 (° C.)/cooling time (second))".

Accordingly, a preferred embodiment of the method for manufacturing copper alloys in accordance with the invention comprises:

a melt-casting process of an ingot containing about 0.5-about 2.5% by weight of Ni, about 0.5-about 2.5% by weight of Co, and about 0.30-about 1.2% by weight of Si, and the balance being Cu and unavoidable impurities, wherein the ratio of the total weight of Ni and Co to the weight of Si ([Ni+Co]/Si ratio) satisfies the formula: about 4≦[Ni+Co]/Si≦about 5, and the ratio of Ni to Co (Ni/Co ratio) satisfies the formula: about 0.5≦ Ni/Co≦about 2;

a hot rolling process;

a cold rolling process;

a solution treatment process of heating to about 700° C.-about 1000° C., and then cooling at the rate of 10° C. per second or more;

an optional cold rolling process;

an age hardening process conducted at about 350° C.-about 550° C.; and an optional cold rolling process;

wherein said processes are conducted in the order as listed above.

Further, in one embodiment of the manufacturing method of the invention, said ingot may further comprise about 0.5% or less by weight of Cr.

In another embodiment of the manufacturing method of the invention, said ingot may further comprises in total about 2.0% or less by weight of one or more elements selected from the group consisting of P, As, Sb, Be, B, Mn, Mg, Sn, Ti, Zr, Al, Fe, Zn and Ag.

Incidentally, it should be understood by those in art that other processes for removing oxide scales on the surface, such as grinding, polishing, shot blast, and pickling may be included as appropriate between each of the aforementioned processes.

A certain embodiment of Cu—Ni—Si copper alloys in accordance with the invention can exhibit 800 MPa or more in 0.2% yield strength, and 45% IACS or more in electrical conductivity. Further, another embodiment can exhibit 840 MPa or more in 0.2% yield strength, and 45% IACS or more in electrical conductivity. Further, another example can exhibit 850 MPa or more in 0.2% yield strength, and 45% IACS or more in electrical conductivity.

Cu—Ni—Si copper alloys in accordance with the invention can be formed into a variety of copper products, such as a plate, strip, pipe, rod and wire. Further, Cu—Ni—Si copper alloys in accordance with the invention can be used for electronic components which are required to satisfy both high-strength and high-electrical conductivity (or thermal conductivity), such as a lead frame, connector, pin, terminal, relay, switch, and foil for secondary battery.

Examples

Examples of the invention are explained hereinafter. However, these examples are shown for better understanding of the invention and its advantages, and the invention is not limited to the examples.

Examples of copper alloys in accordance with the invention contain different amounts of Ni, Co and Si, and also contain Mg, Sn, Zn, Ag, Ti and Fe as appropriate, as shown in Table 1. Comparative examples of copper alloys are Cu—Ni—Si alloys having parameters outside of the range of the invention.

Copper alloys having compositions shown in Table 1 were melted with a high-frequency melting furnace at 1100° C. or higher, and were cast into ingots having thickness of 25 mm. Then, after the ingots were heated to 900° C. or higher, they were hot-rolled to the thickness of 10 mm, and cooled immediately. After their surfaces were grinded to remove scales on the surface such that the resulting thickness became 9 mm, they were cold-rolled to the thickness of 0.3 mm. Next, they underwent solution treatment for 5-3600 seconds at 950° C. corresponding to the total amount of Ni and Co, then immediately cooled to 100° C. or lower at the rate of about 10° C.

per second. Then, they were cold-rolled to 0.15 mm, and finally, they underwent age hardening for 1-24 hours at 500° C. in inert atmosphere corresponding to the amount of additives to obtain test pieces.

Characteristic evaluation on strength and electrical conductivity was performed for each of alloys manufactured in the illustrative method. Tensile test in the direction parallel to the rolling direction was conducted to measure 0.2% yield strength (YS), and electric conductivity (EC; % IACS) was measured by volume resistivity measurement using double bridge.

Bending workability was measured by 90 degree bending under the condition that the ratio of thickness and bending radius of a test piece becomes 1. The surface of bending portion was observed with an optical microscope, and when no crack was found, the test piece was recognized as non-defective (good), and when any crack was found, it was recognized as defective (bad).

Stress relaxation characteristic was measured in accordance with EMAS-3003. Each test piece was put under the bending stress corresponding to 80% of 0.2% yield strength in atmosphere of 150° C. for 1000 hours to measure stress relaxation characteristic. The target value of relaxation rate for good stress relaxation characteristic was 20%, and if the value was lower than that, the test piece was recognized as excellent. With regard to surface characteristic, solderability was evaluated. Solderability was measured using Meniscograph method. Each test piece was immersed to the depth of 2 mm into 60% Sn—Pb bath at 235±3° C. for 10 seconds, and solder wetting time, i.e., the time required to thoroughly wet the test piece was measured. In addition, as a preliminary treatment for solderability evaluation, it was degreased by acetone, and pickled by immersing the test pieces into 10 vol % sulfuric acid solution for 10 second, water-washed, dried, and applied flux by immersing into 25% rosin-ethanol solution for 5 second. The target value for good solder wetting time was 2 seconds or less.

TABLE 1

| Examples of The Invention | Ni | Co | Si | Cr | Others | [Ni + Co]/Si | Ni/Co | YS | EC | Bendability | Stress Relaxation (%) | Solder Wettability (%) |
|---|---|---|---|---|---|---|---|---|---|---|---|---|
| 1 | 0.70 | 0.70 | 0.30 | | | 4.67 | 1.00 | 730 | 51 | good | 12 | 0.6 |
| 2 | 0.70 | 1.00 | 0.40 | | | 4.25 | 0.70 | 740 | 51 | good | 12 | 0.7 |
| 3 | 0.70 | 1.30 | 0.43 | | | 4.65 | 0.54 | 750 | 49 | good | 15 | 0.7 |
| 4 | 1.30 | 0.70 | 0.47 | | | 4.26 | 1.86 | 790 | 47 | good | 14 | 0.9 |
| 5 | 1.30 | 1.30 | 0.60 | | | 4.33 | 1.00 | 805 | 47 | good | 14 | 1.0 |
| 6 | 1.30 | 1.80 | 0.65 | | | 4.77 | 0.72 | 825 | 46 | good | 15 | 1.0 |
| 7 | 2.00 | 1.20 | 0.72 | | | 4.44 | 1.67 | 820 | 47 | good | 17 | 1.2 |
| 8 | 2.00 | 1.40 | 0.85 | | | 4.00 | 1.43 | 840 | 46 | good | 17 | 1.2 |
| 9 | 2.00 | 1.80 | 0.88 | | | 4.32 | 1.11 | 850 | 44 | good | 18 | 1.3 |
| 10 | 0.70 | 0.70 | 0.30 | 0.20 | | 4.67 | 1.00 | 735 | 55 | good | 12 | 0.6 |
| 11 | 0.70 | 1.00 | 0.40 | 0.20 | | 4.25 | 0.70 | 745 | 55 | good | 12 | 0.7 |
| 12 | 0.70 | 1.30 | 0.43 | 0.20 | | 4.65 | 0.54 | 755 | 53 | good | 13 | 0.7 |
| 13 | 1.30 | 0.70 | 0.47 | 0.20 | | 4.26 | 1.86 | 795 | 51 | good | 15 | 0.9 |
| 14 | 1.30 | 1.30 | 0.60 | 0.20 | | 4.33 | 1.00 | 810 | 51 | good | 14 | 1.0 |
| 15 | 1.30 | 1.80 | 0.65 | 0.20 | | 4.77 | 0.72 | 830 | 50 | good | 14 | 1.0 |
| 16 | 2.00 | 1.20 | 0.72 | 0.20 | | 4.44 | 1.67 | 825 | 51 | good | 14 | 1.2 |
| 17 | 2.00 | 1.40 | 0.85 | 0.20 | | 4.00 | 1.43 | 845 | 50 | good | 14 | 1.2 |
| 18 | 2.00 | 1.80 | 0.88 | 0.20 | | 4.32 | 1.11 | 855 | 48 | good | 15 | 1.3 |
| 19 | 1.30 | 1.30 | 0.60 | 0.20 | 0.1 Mg | 4.33 | 1.00 | 880 | 44 | good | 15 | 0.8 |
| 20 | 1.30 | 1.30 | 0.60 | 0.20 | 0.5 Sn | 4.33 | 1.00 | 825 | 49 | good | 14 | 1.0 |
| 21 | 1.30 | 1.30 | 0.60 | 0.20 | 0.5 Zn | 4.33 | 1.00 | 830 | 48 | good | 14 | 1.0 |
| 22 | 1.30 | 1.30 | 0.60 | 0.20 | 0.1 Ag | 4.33 | 1.00 | 815 | 50 | good | 15 | 1.1 |
| 23 | 1.30 | 1.30 | 0.60 | 0.20 | 0.3 Ti | 4.33 | 1.00 | 820 | 51 | good | 14 | 1.1 |
| 24 | 1.30 | 1.30 | 0.60 | 0.20 | 0.2 Fe | 4.33 | 1.00 | 830 | 48 | good | 14 | 1.1 |
| **Comparative Examples** | **Ni** | **Co** | **Si** | **Cr** | **Others** | **[Ni + Co]/Si** | **Ni/Co** | **YS** | **EC** | **Bendability** | **Stress Relaxation Ability (%)** | **Solder Wettability (%)** |
| 1 | 2.00 | 0.00 | 0.80 | — | | 4.00 | — | 580 | 40 | good | 10 | 2.2 |
| 2 | 0.40 | 0.40 | 0.20 | — | | 4.00 | 1.00 | 560 | 60 | good | 13 | 0.8 |
| 3 | 0.40 | 1.00 | 0.30 | — | | 4.67 | 0.40 | 580 | 61 | good | 10 | 0.7 |
| 4 | — | 1.00 | 0.20 | 0.10 | | 5.00 | — | 550 | 62 | good | 23 | 1.2 |
| 5 | — | 2.60 | 0.62 | 0.10 | | 4.19 | — | 708 | 57 | good | 28 | 1.6 |
| 6 | 1.30 | 0.40 | 0.40 | 0.10 | | 4.25 | 3.25 | 780 | 42 | good | 16 | 1.1 |
| 7 | 1.80 | 0.80 | 0.60 | — | | 4.33 | 2.25 | 789 | 42 | good | 13 | 1.2 |
| 8 | 2.20 | 1.00 | 0.70 | — | | 4.57 | 2.20 | 829 | 43 | good | 12 | 1.6 |
| 9 | 2.70 | 1.00 | 0.80 | 0.10 | | 4.63 | 2.70 | 800 | 38 | good | 11 | 2.8 |
| 10 | 0.50 | 1.50 | 0.50 | 0.10 | | 4.00 | 0.33 | 690 | 50 | bad | 22 | 1.3 |
| 11 | 0.80 | 1.80 | 0.60 | — | | 4.33 | 0.44 | 770 | 43 | bad | 26 | 0.7 |
| 12 | 1.00 | 2.70 | 0.80 | — | | 4.63 | 0.37 | 770 | 40 | bad | 23 | 1.3 |
| 13 | 1.00 | 1.20 | 0.70 | 0.10 | | 3.14 | 0.83 | 720 | 43 | good | 12 | 2.9 |
| 14 | 1.50 | 1.80 | 1.00 | — | | 3.30 | 0.83 | — | — | — | — | — |
| 15 | 0.80 | 1.60 | 0.40 | 0.10 | | 6.00 | 0.50 | 680 | 50 | good | 10 | 1.5 |
| 16 | 1.30 | 1.30 | 0.40 | — | | 6.50 | 1.00 | 710 | 45 | good | 11 | 1.8 |
| 17 | 1.30 | 1.30 | 0.60 | 0.70 | | 4.33 | 1.00 | 770 | 44 | bad | 25 | 2.9 |
| 18 | 1.30 | 1.30 | 0.60 | 0.10 | 1.1 Sn, 1.2 Zn | 4.33 | 1.00 | 800 | 35 | good | 12 | 1.8 |

With reference to Table 1, the result of characteristic evaluation was explained hereinafter.

Compared to Comparative example 1, which didn't contain Co, Examples 1-16 in accordance with the invention had dramatically improved strength and moderately improved electrical conductivity. In addition, they also had excellent bending workability, stress relaxation characteristic, and solderability. Further, it can be seen that Examples 10-24, which contained Cr, exhibited improved electrical conductivity, and Examples 19-24, which contained Mg, Sn or the like, also had improved strength. Comparative example 1 was an example which didn't contain Co. It was inferior to the invention in both strength and electrical conductivity. Further, due to higher solid solution Si concentration, an oxide film was formed and solderability was deteriorated. Comparative example 2 was an example which had insufficient concentrations of Ni and Co. Because of this reason, the strength of the sample was not improved as much as that of the invention.

Comparative example 3 was an example in which Ni was insufficient. Although electrical conductivity was improved, there was no improvement in strength.

On the contrary to Comparative example 1, Comparative example 4 was an example which didn't contain Ni. It contained Cr in an attempt to improve electrical conductivity. Although electrical conductivity was improved, there was no improvement in strength due to the lack of Ni. In addition, crystallizations grew enlarged, and stress relaxation characteristic was impaired.

Comparative example 5 also didn't contain Ni, but contained 2.6 wt % of Co, which was higher than that of Comparative example 4. Although it had higher strength and electrical conductivity than Comparative example 1, which didn't contain Co, the improvement of strength was less than that of the invention. In addition, crystallizations grew enlarged, and stress relaxation characteristic was extremely impaired.

Comparative example 6 was an example in which Ni/Co ratio was too high. Although strength was improved, electrical conductivity was unsatisfactory, thus it could not achieve the simultaneous improvement of strength and electrical conductivity.

Comparative example 7 was also an example in which Ni/Co ratio was too high. Although Ni/Co ratio was closer to the defined range of the invention than that of Comparative example 6, electrical conductivity was still unsatisfactory, thus it could not achieve the simultaneous improvement of strength and electrical conductivity.

Comparative example 8 was also an example in which Ni/Co ratio was too high. Although Ni/Co ratio was further closer to the defined range of the invention, thereby closer to the critical condition than that of Comparative example 7, it was still outside of the range, and thereby it could not achieve the simultaneous improvement of strength and electrical conductivity.

Comparative example 9 was also an example in which Ni/Co ratio was too high. Although it contained Cr in an attempt to compensate the unsatisfactory electrical conductivity, the actual electrical conductivity decreased, rather than increased. It has suggested that the effect of Cr would not be exerted effectively when Ni/Co ratio is too high. Further, solderability was also extremely deteriorated.

Comparative example 10 was an example in which Ni/Co ratio was too low. Although electrical conductivity was better than the cases in which Ni/Co ratio was too high due to the contribution of Cr, strength was insufficient instead. Crystallizations grew enlarged, and bendability was deteriorated. Stress relaxation characteristic was also impaired.

Comparative example 11 was also an example in which Ni/Co ratio was too low. Ni/Co ratio was closer to the defined range of the invention than that of Comparative example 10. Although strength was improved, electrical conductivity was unsatisfactory, thus it could not achieve the simultaneous improvement of strength and electrical conductivity. In addition, crystallizations grew enlarged, and bendability was deteriorated. Stress relaxation characteristic was also impaired.

Comparative example 12 was also an example in which Ni/Co ratio was too low. Co concentration was higher than that of Comparative example 11 in an attempt to improve strength and electrical conductivity due to the additional Co. However, strength was as low as Comparative example 11, and electrical conductivity was lower than that of Comparative example 11. In addition, crystallizations grew enlarged, and bendability and stress relaxation characteristic remained unsatisfactory.

Comparative example 13 was an example in which [Ni+Co]/Si ratio was too low. Although strength was improved, there was a little improvement in electrical conductivity regardless of the addition of Cr, thus it could not achieve the simultaneous improvement of strength and electrical conductivity. In addition, solderability was also poor.

Comparative example 14 was also an example in which [Ni+Co]/Si ratio was too low. Due to higher Si concentration than Comparative example 13, the sample was cracked during hot rolling, and thereby characteristic evaluation could not be performed.

Comparative example 15 was an example in which [Ni+Co]/Si ratio was too high. Although electrical conductivity was improved partly due to the addition of Cr, there was a little improvement in strength, thus it could not achieve the simultaneous improvement of strength and electrical conductivity.

Comparative example 16 was also an example in which [Ni+Co]/Si ratio was too high. Ni concentration was higher than that of Comparative example 15. Although there was larger improvement in strength, it still could not achieve the simultaneous improvement of strength and electrical conductivity.

Comparative example 17 was the same as Example 5 except that it has excessively higher Cr concentration. Both strength and electrical conductivity were lowered because of the excessive Cr, thus it could not achieve as much improvements in both of strength and electrical conductivity as those of Example 5. In addition, due to the residual of enlarged crystallizations, all of bending workability, solderability, stress relaxation characteristic were deteriorated.

Comparative example 18 contained the same amount of Ni, Co and Si as Example 5 except that it had also contained other additive elements in excess. Electrical conductivity was lowered, thus it could not achieve as much improvements in both of strength and electrical conductivity as those of example 5.

FIG. 1 shows the relation between strengths (YS) and electrical conductivities (EC) for Examples (1-24) of the invention, Comparative examples (2, 3, 6, 7, 8, 15, 16 and 17) which exhibited relatively good bending workability, stress relaxation characteristic, and solderability, and Comparative example 1 which didn't contain Co. It visually illustrates that Cu—Ni—Co—Si alloys in accordance with the invention could achieve the simultaneous improvement of strength and electrical conductivity in a higher level.

Examination of the Effect of Cooling Rate on Strength

Next, the effect of cooling rate on strength and electrical conductivity of copper alloys during solution treatment were examined. Changes in strength and electrical conductivity of resulting copper alloys were examined when cooling rate was changed between 5° C./second and 20° C./second and other conditions were unchanged during solution treatment in the manufacturing process for the previous examples 1-18 (except for examples 8 and 17). The result is shown in Table 2. It can be seen that the higher the cooling rate was, the more the strength was.

TABLE 2

| No. (corresponding to previous examples) | Cooling Rate (° C./s) | YS (MPa) | EC (% IACS) |
|---|---|---|---|
| 1 | 5 | 600 | 54 |
| | 10 | 730 | 51 |
| | 20 | 745 | 50 |
| 2 | 5 | 610 | 54 |
| | 10 | 740 | 51 |
| | 20 | 755 | 49 |
| 3 | 5 | 620 | 52 |
| | 10 | 750 | 49 |
| | 20 | 765 | 49 |
| 4 | 5 | 695 | 49 |
| | 10 | 790 | 47 |
| | 20 | 805 | 47 |
| 5 | 5 | 705 | 50 |
| | 10 | 805 | 47 |
| | 20 | 820 | 47 |
| 6 | 5 | 720 | 49 |
| | 10 | 825 | 46 |
| | 20 | 840 | 45 |
| 7 | 5 | 715 | 49 |
| | 10 | 820 | 47 |
| | 20 | 835 | 47 |
| 9 | 5 | 745 | 46 |
| | 10 | 850 | 44 |
| | 20 | 860 | 43 |
| 10 | 5 | 605 | 56 |
| | 10 | 735 | 55 |
| | 20 | 760 | 53 |
| 11 | 5 | 615 | 56 |
| | 10 | 745 | 55 |
| | 20 | 770 | 52 |
| 12 | 5 | 625 | 54 |
| | 10 | 755 | 53 |
| | 20 | 780 | 51 |
| 13 | 5 | 690 | 52 |
| | 10 | 795 | 51 |
| | 20 | 820 | 49 |
| 14 | 5 | 710 | 52 |
| | 10 | 810 | 51 |
| | 20 | 835 | 49 |
| 15 | 5 | 720 | 51 |
| | 10 | 830 | 50 |
| | 20 | 855 | 48 |
| 16 | 5 | 710 | 53 |
| | 10 | 825 | 51 |
| | 20 | 850 | 50 |
| 18 | 5 | 730 | 49 |
| | 10 | 855 | 48 |
| | 20 | 875 | 46 |

Those skilled in the art can readily come up with many variations from the disclosure of the present invention without departing from the essential feature and intent of the invention. Therefore, the invention should not be limited to these embodiments and such variations and other embodiments are also included in the present invention as defined by the appended claims.

What is claimed is:

1. A copper alloy for electronic materials, consisting essentially of 0.5 to 2.5% by weight of Ni, 0.5 to 2.5% by weight of Co, 0.30 to 1.2% by weight of Si, 0.1 to 0.5% by weight of Cr, optionally in total about 2.0% or less by weight of one or more elements selected from the group consisting of P, As, Sb, B, Mn, Mg, Sn, Ti, Zr, Al, Fe, Zn and Ag, and the balance being Cu and unavoidable impurities, wherein the ratio of the total weight of Ni and Co to the weight of Si ([Ni+Co]/Si ratio) satisfies the formula: $4 \leqq [Ni+Co]/Si \leqq 5$, and the ratio of Ni to Co (Ni/Co ratio) satisfies the formula: $0.5 \leqq Ni/Co \leqq 2$; and wherein the alloy has a 0.2% yield strength of 800 MPa or more and an electrical conductivity of 45% IACS or more.

2. The copper alloy for electronic materials as claimed in claim 1, further containing in total about 2.0% or less by weight of one or more elements selected from the group consisting of P, As, Sb, B, Mn, Mg, Sn, Ti, Zr, Al, Fe, Zn and Ag.

3. A copper product comprising the copper alloy as claimed in claim 1 or 2.

4. An electronic component comprising the copper alloy as claimed in claim 1 or 2.

5. A method for manufacturing copper alloys for electronic materials according to claim 1, comprising:

melt-casting an ingot consisting essentially of 0.5 to 2.5% by weight of Ni, 0.5 to 2.5% by weight of Co, 0.30 to 1.2% by weight of Si, 0.1 to 0.5% by weight of Cr, and the balance being Cu and unavoidable impurities, wherein the ratio of the total weight of Ni and Co to the weight of Si ([Ni+Co]/Si ratio) satisfies the formula: $4 \leqq [Ni+Co]/Si \leqq 5$, and the ratio of Ni to Co (Ni/Co ratio) satisfies the formula: $0.5 \leqq Ni/Co \leqq 2$;

hot rolling the ingot;

cold rolling;

solution treating with heating to about 700° C. to about 1000° C., and then cooling at the rate of 10° C. per second or more;

optionally cold rolling;

age hardening conducted at about 350° C. to about 550° C.; and optionally cold rolling;

wherein said processes are conducted in the order as listed above; and wherein the alloy has a 0.2% yield strength of 800 MPa or more and an electrical conductivity of 45% IACS or more.

6. A method for manufacturing copper alloys for electronic materials as claimed in claim 2, comprising:

melt-casting of an ingot consisting essentially of 0.5 to 2.5% by weight of Ni, 0.5 to 2.5% by weight of Co, 0.30 to 1.2% by weight of Si, 0.1 to 0.5% by weight of Cr, and in total 2.0% or less by weight of one or more elements selected from the group consisting of P, As, Sb, B, Mn, Mg, Sn, Ti, Zr, Al, Fe, Zn and Ag, and the balance being Cu and unavoidable impurities, wherein the ratio of the total weight of Ni and Co to the weight of Si ([Ni+Co]/Si ratio) satisfies the formula: $4 \leqq [Ni+Co]/Si \leqq 5$, and the ratio of Ni to Co (Ni/Co ratio) satisfies the formula: $0.5 \leqq Ni/Co \leqq 2$;

hot rolling the ingot;

cold rolling;

solution treating with heating to about 700° C. to about 1000° C. and then cooling at the rate of 10° C. per second or more;

optionally cold rolling;

age hardening conducted at about 350° C. to about 550° C.; and optionally cold rolling;

wherein said processes are conducted in the order as listed above; and wherein the alloy has a 0.2% yield strength of 800 MPa or more and an electrical conductivity of 45% IACS or more.

* * * * *